United States Patent [19]

Counselman

[11] 4,183,157

[45] Jan. 15, 1980

[54] OVERSHOES FOR SPIKED SHOES

[76] Inventor: Clarence J. Counselman, 10 Sailfish Dr., Vero Beach, Fla. 32960

[21] Appl. No.: 955,928

[22] Filed: Oct. 30, 1978

[51] Int. Cl.[2] ..... A43B 5/00

[52] U.S. Cl. ..... 36/135

[58] Field of Search ..... 36/135, 7.1, 7.3

[56] References Cited

U.S. PATENT DOCUMENTS

| | | | |
|---|---|---|---|
| 3,313,047 | 4/1967 | Svien | 36/135 |
| 3,821,858 | 7/1974 | Haselden | 36/135 |
| 4,055,005 | 10/1977 | Meinhart | 36/135 |

*Primary Examiner*—Patrick D. Lawson
*Attorney, Agent, or Firm*—Carroll F. Palmer

[57] ABSTRACT

Overshoes for covering the soles of golf or like spiked shoes comprise separated front sole and rear heel portions formed of resilient sheet material of specified thickness and durometer, elastic strips fixed to the sides of the sole and heel portions bridging the gap between them and shoe toe and heel engaging elements fixed to the front of the sole portion and rear of the heel portion respectively. A single size of such overshoe can be used to cover many different sizes of spiked shoes.

3 Claims, 7 Drawing Figures

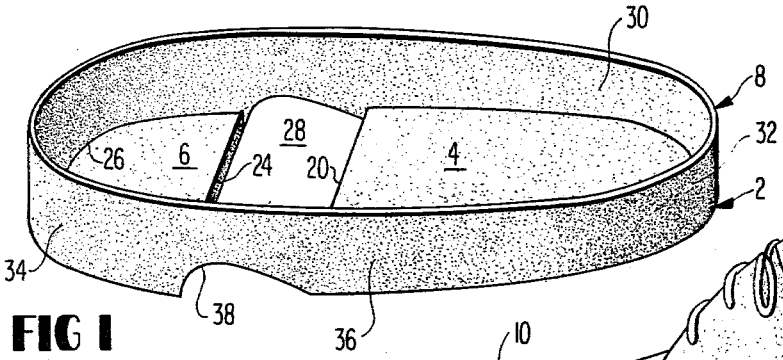
FIG 1
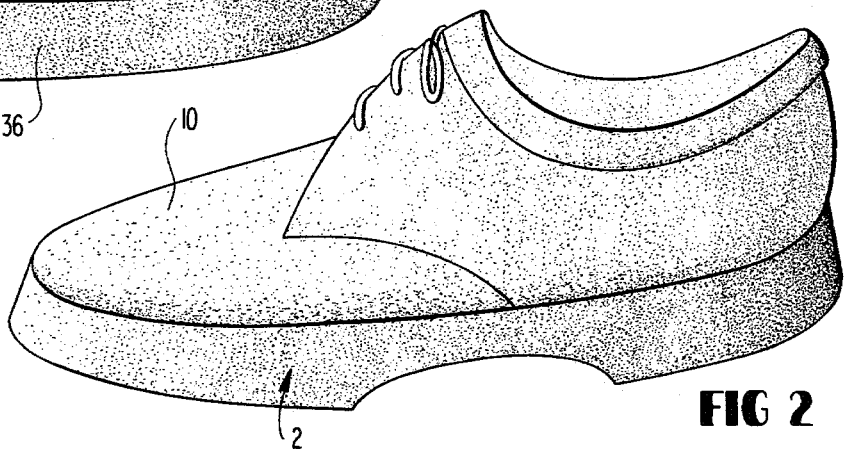
FIG 2
FIG 3
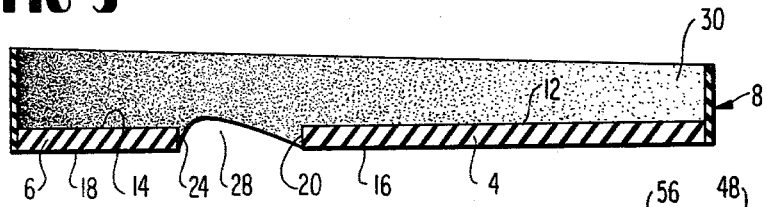
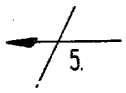
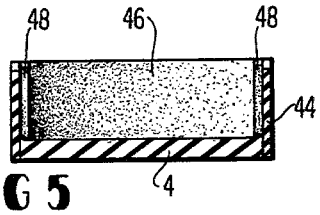
FIG 5
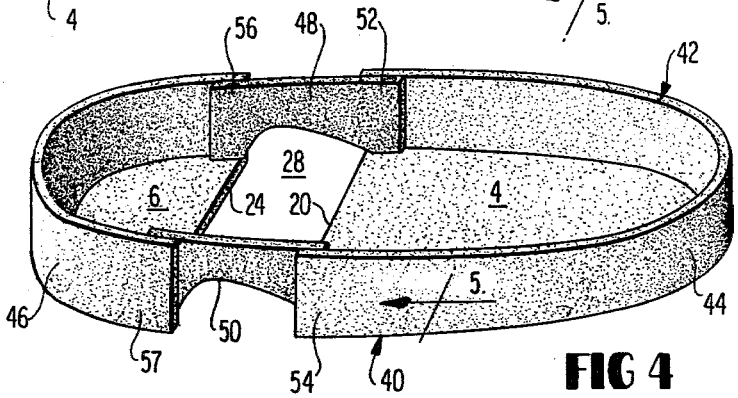
FIG 4
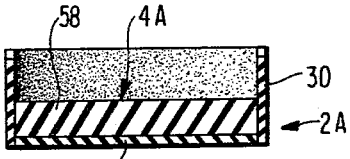
FIG 6
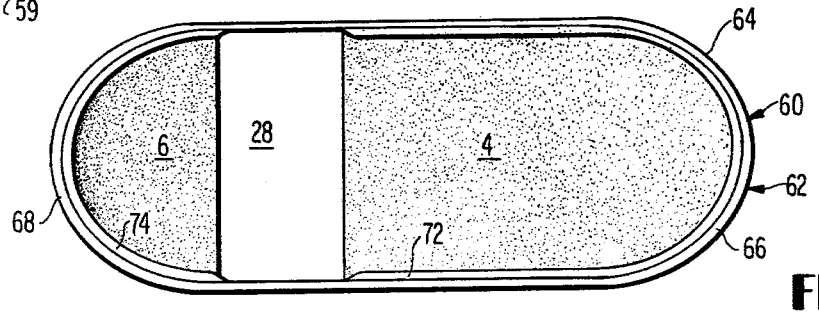
FIG 7

OVERSHOES FOR SPIKED SHOES

BACKGROUND OF THE INVENTION

1. Field of the Invention

This invention broadly relates to overshoes. More particularly, it concerns overshoes for covering the soles of golf or like spiked shoes in order that the wearer may walk over surfaces that would otherwise be damaged by the spikes.

2. Description of the Prior Art

Golf shoes equipped with a plurality of spikes protruding from their undersurface are of great assistance to golfers when they are walking on turf in the course of golf play. However, when the wearer wishes to walk on a hard surface, e.g., the floor of a building or a hard surfaced pathway, damage may occur to the spikes and/or the walking surface. Many golf clubs require removal of golf shoes before entering the club house or other building. Even in the absence of such rules, walking in the spiked shoes on a hard surface can be uncomfortable.

What has been said above also applies to other types of shoes equipped with undersurface spikes or cleats, e.g., baseball shoes, football shoes, soccer shoes, etc., and the overshoes of this invention may advantageously be used for covering all such type shoes.

The problem presented by spiked shoes in walking on hard surfaces has long been known and various shoe covering devices have been devised for the purpose of mitigating the problem. Examples of prior art devices for such purpose are disclosed, for example, in U.S. Pats. Nos. 1,811,781; 2,032,052; 2,958,963 and 3,176,416.

Notwithstanding the prior developments in the field of this invention, there exists a need for improvements in overshoe devices for golf and like spiked shoes so that they can be made available to wearers at low cost and can be carried and used by them in an easy manner.

OBJECTS

A principal object of this invention is the provision of improvements in overshoes for covering the soles of golf or like spiked shoes.

Further objects include the provision of:

1. Overshoes for spiked shoes that can be made and sold very inexpensively.
2. Such overshoes that can be made in a single size to fit a wide range of wearer shoe sizes.
3. Such overshoes that fit either right or left shoes with equal ease.
4. Such overshoes that have minimal weight, can be stored in a minimum of space, are long lasting and can be easily cleaned.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by constructing overshoes for spiked shoes from separate front sole and rear heel portions of resilient sheet material and fixing strips of elastomeric material to the sides of such portions bridging the gap between them. Strips of material are also fixed in an upright position to the front and rear edges of the sole and heel portions respectively to provide means for engaging the toe and heel of a spiked shoe so the overshoe may be applied thereto and held on it by the elastic action of the side strips of the overshoe.

In their preferred form, the side strips are integral with the toe and heel strips and are formed of a continuous band of rubber cemented to the peripheral edges of the sole and heel portions of the overshoe.

The sheet material of which the sole and heel portions are formed should be sufficiently soft to readily allow the shoe spikes to indent it, but hard enough not to be collapsed by the wearer's weight so the spikes will not penetrate the lower, walking surface. Advantageously, the sole and heel sheet material has a thickness between about 10 to 20 mm. and a Shore A Durometer value, as measured by ASTM specification D-2240, of between about 20 to 45. Also, the rubber band cemented to the edges of the sole and heel portions has a thickness between about 1 to 2 mm.

BRIEF DESCRIPTION OF THE DRAWINGS

A more complete understanding may be had by reference to the accompanying drawings in which:

FIG. 1 is a perspective view of an overshoe for spiked shoes in accordance with the invention.

FIG. 2 is a perspective view of the overshoe of FIG. 1 applied to a spiked shoe.

FIG. 3 is a lateral, sectional view of the overshoe of FIG. 1.

FIG. 4 is a perspective view of a modified form of an overshoe of the invention.

FIG. 5 is a sectional view taken on the line 5—5 of FIG. 4.

FIG. 6 is a sectional view similar to FIG. 5 showing a modified form of the overshoe of FIG. 1.

FIG. 7 is a plan view of yet another form of overshoe of the invention.

DESCRIPTION OF PREFERRED EMBODIMENTS

Referring in detail to the drawings, the overshoe 2 comprises a front sole section 4, rear heel portion 6 and strip portion 8. The sole portion 4 and heel portion 6 are formed of resilient sheet material advantageously having a thickness between about 10 to 20 mm., a Shore type A Durometer value (ASTM spec. D-2240) between about 20 to 45, and density about 0.5 to 1. Such material permits the spikes of a golf shoe 10 to indent the top surfaces 12 and 14 of portions 4 and 6 respectively, but does not allow the spikes to fully penetrate so that spikes do not protrude through the bottom surfaces 16 and 18.

The sole portion 4 has a transverse rear section 20 and an arcuate forward section 22. Similarly, the heel portion 6 has a transverse front section 24 and an arcuate rearward section 26. The portions 4 and 6 are sized so that they can accommodate a multiplicity of shoe size, e.g., men's shoe sizes 6–9 and another for 10–14.

The sole portion 4 and heel portion 6 are spaced apart from one another so there is a gap 28 between rear section 20 and front section 24 of portions 4 and 6 respectively.

In the form of overshoe shown in FIGS. 1–3, the strip portion 8 consists of a continuous band 30 of elastomeric material that is wider at the rear 34 than at the front 32 and the sides 36. There is an arcuate cut-out portion 38 in the band 30 coincident with the gap 28 between sole portion 4 and heel portion 6. Preferably the band 30 is formed of vulcanized rubber having a thickness about 1 to 2 mm. It is fixed by rubber cement or other adhesive to the peripheral edges of the sole portion 4 and heel portion 6.

In the form of overshoe 40 shown in FIGS. 4 and 5, the band 42 comprises a front section 44, rear section 46 and side sections 48. The side sections have the cut-out portions 50 and are formed of vulcanized rubber or other elastomeric material. The front and rear sections 44 and 46 may be made of fabric, flexible plastic, e.g., plasticized polyvinyl chloride, rubber or other flexible or rigid material. The sections 44 and 46 are fixed by adhesive, thermal welding or equivalent means at their lower edges to the periphery of portions 4 and 6. The side sections 48 are fixed by adhesive, thermal welding or the like at their front ends 52 to rear ends 54 of section 44 and at their rear ends 56 to the front ends 57 of section 46. The elasticity in the side sections 48 enable the overshoe 40 to fit a multiplicity of spiked shoe sizes.

In the modified form of overshoe 2A shown in FIG. 6, the sole portion 4A is made of laminated material having an inner layer 58 and an outer layer 59. Advantageously, layer 58 is a soft sponge rubber material (Type A Durometer value 7 to 10) and the layer 59 is a relatively thin, e.g., 1-2 mm., hard sheet material (Type A Durometer value 60-75).

In the overshoe 60 shown in FIG. 7, the strip portion 62 is a continuous band 64 of elastic material in which the front section 66 and rear section 68 are thicker than the side sections 70 that are coincident with the gap 28 between the sole portion 4 and heel portion 6. The added thickness in sections 64 and 66 may be due to these being molded or cast thicker than section 70. Alternatively, this may be due to inner strips 72 and 74 being laminated to the inner vertical surfaces of sections 64 and 66 respectively. The added thickness in these front and rear sections can add stiffness to the front and rear to assist in applying the overshoe 60 to a golf shoe. As with the overshoes 2 and 40, the strip portion 62 is fixed to the edges of portions 4 and 6 by adhesive, thermal welding or the like.

All forms of the new overshoes are easily carried and used by a golfer or other wearer of spiked shoes. In carrying the overshoes, the user can double the rear portion 6 back over the sole portion 4 so that the former fits into the latter, thus reducing the length of the cover or other package used to house and carry the overshoes. Furthermore, where the bands 8, 42 or 62 are made of flexible material, the overshoes may be compressed into a relatively thin package that occupies little space.

With the overshoes in place over golf shoes, it is not necessary to change shoes to drive an automobile or to walk on floor surfaces susceptible to damage from spikes. In addition to use with spiked shoes, the new overshoes can be used over conventional shoes to protect boat decks, etc. Also, they are highly practical as replacements for bulky, difficult to apply conventional overshoes. As an added feature, a golfer wearing the new overshoes is not grounded so they can provide a measure of protection to a wearer against lightning during thunderstorms.

The embodiments of the invention in which an exclusive property or privilege is claimed are defined as follows:

1. An overshoe for covering the sole of a shoe having a plurality of spikes protruding therefrom which comprises a front sole portion a rear heel portion separate from said front sole portion, said sole and heel portion being formed of resilient sheet material having a thickness between about 10 to 20 mm. and a Shore type A Durometer of between about 20 to 45, strips of elastomeric material having a thickness between about 1 to 2 mm. fixed to the sides of said sole portion and said heel portion and bridging the separation therebetween, a strip of material fixed to said sole portion along the front edge thereof and extending above its top surface to provide means to engage the toe of a shoe and a strip of material fixed to said heel portion along the rear edge thereof and extending above its top surface to provide means to engage the heel of a shoe.

2. The overshoe of claim 1 wherein said side, front edge and rear edge strips are all formed of one integral piece of elastomeric material.

3. The overshoe of claim 2 wherein said elastomeric material is a band of vulcanized rubber wider at the rear than at the front and at the sides, said band being cemented to peripherial edges of said sole and heel portions.

* * * * *